United States Patent [19]

Lachance

[11] 4,238,869

[45] Dec. 16, 1980

[54] LIQUID ASPIRATOR

[76] Inventor: Fernand Lachance, 330, 153e Rue Est, Ville St-Georges, Beauce, Quebec, Canada, G5Y 2J6

[21] Appl. No.: 963,367

[22] Filed: Nov. 24, 1978

[30] Foreign Application Priority Data

Mar. 20, 1978 [CA] Canada ..... 299285

[51] Int. Cl.[3] ..... A47L 7/00

[52] U.S. Cl. ..... 15/353

[58] Field of Search ..... 15/320, 321, 353

[56] References Cited

U.S. PATENT DOCUMENTS

| | | | |
|---|---|---|---|
| 1,690,472 | 11/1928 | Breton | 15/320 |
| 2,693,000 | 11/1954 | Minerley | 15/320 |
| 2,763,886 | 9/1956 | Brown et al. | 15/353 X |
| 3,018,504 | 1/1962 | Hart | 15/353 X |
| 3,065,489 | 11/1962 | Wright | 15/353 |
| 3,079,626 | 3/1963 | Yonkers et al. | 15/353 X |
| 3,267,511 | 8/1966 | Meyerhoefer | 15/353 |
| 3,854,163 | 12/1974 | Evans | 15/321 |
| 3,883,301 | 5/1975 | Emrick et al. | 15/321 X |

*Primary Examiner*—Christopher K. Moore
*Attorney, Agent, or Firm*—Cushman, Darby & Cushman

[57] ABSTRACT

The use of liquid aspirators which are connected to conventional vacuum cleaners is known. In this invention a reservoir-body of an elongated form extends at its lower part to a nozzle, and at its upper part to a lid which is provided with an end-piece for the attachment of an external hose from a conventional vacuum cleaner. The said lid is placed on the inside of a lid-handle which extends above the reservoir-body. A tube following the nozzle penetrates into the interior of the elongated body-reservoir to discharge the liquid, where in the interior of the said body spacers and separators are provided, while a transparent window permits viewing the level of the liquid and a float closes the air vacuum when the level of the liquid reaches a predetermined value. Some baffle-plates and a filter are provided to prevent sprayed drops of water from being drawn towards the vacuum cleaner and damaging its electric motor.

9 Claims, 3 Drawing Figures

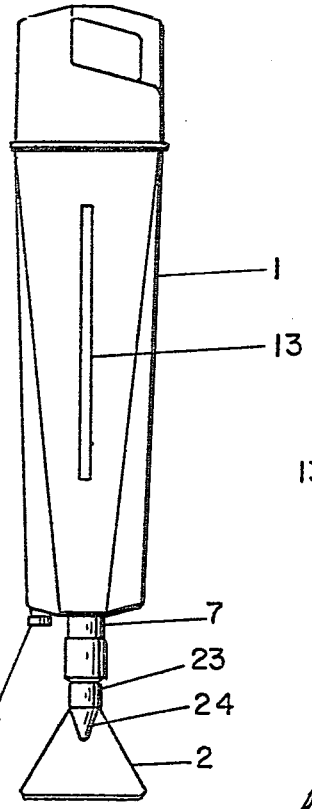
Fig. 3.
Fig. 2.
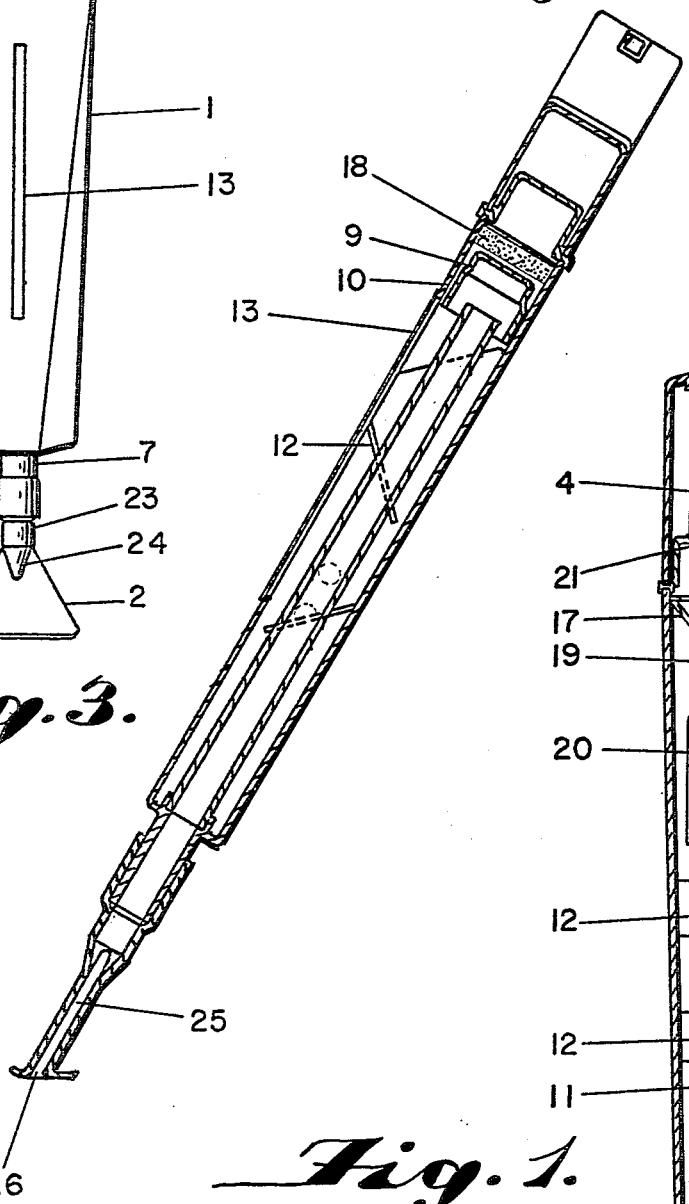
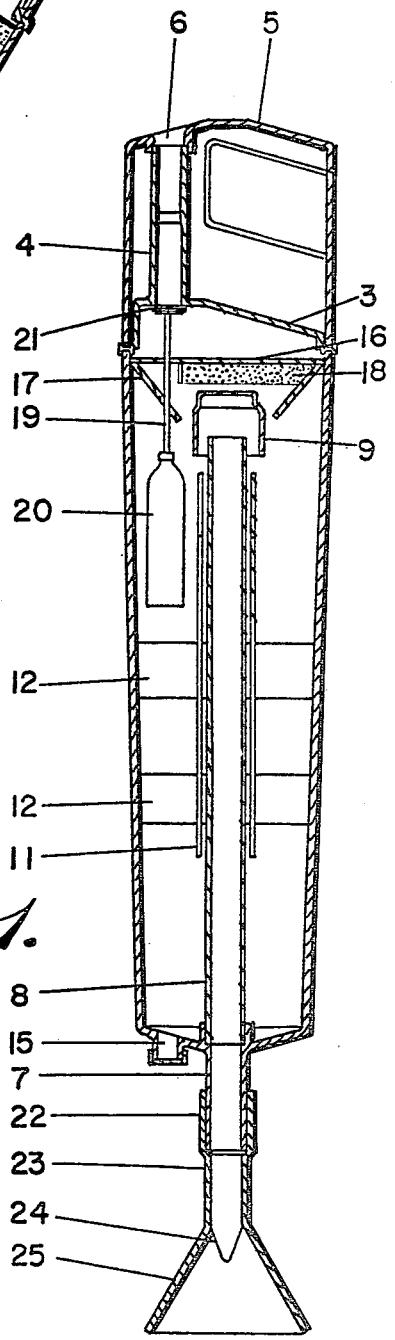
Fig. 1.

LIQUID ASPIRATOR

BACKGROUND OF THE INVENTION

Liquid is absorbed during the cleaning of floors and carpets using, among other means, appliances which are connected to conventional vacuum cleaners. These devices include reservoirs formed of two parts screwed together at their center and reservoirs in which a conduit is connected to the vacuum cleaner while another circuit is connected to the exterior nozzle. A filter, intended to retain the solid particles contained in the absorbed liquid is typically also included as a part of the structure of these devices.

Known liquid absorption devices exhibit several major inconveniences to the user including their cumbersome form which makes them difficult for the user to manipulate, the difficulties of emptying the collected liquid, and generally inadequate protection of the electric motor against penetration of water droplets.

I have now discovered that these and other inconveniences can be obviated by the use of a liquid aspirator which is conveniently attached to a conventional vacuum cleaner.

BRIEF DESCRIPTION OF THE INVENTION

The liquid aspirator according to my invention includes an elongated body reservoir defined at its lower part by a nozzle and at its upper part by a lid. From the lid an end-piece extends which is provided for attachment to the exterior hose of a vacuum cleaner. The said lid is placed on the interior of a lid-handle which extends the reservoir. A tube extending from the nozzle penetrates the interior of the reservoir and leads into an inverted cup without touching its bottom, to discharge the liquid there. Spacers are provided to prevent the possibility of buckling of the reservoir during the suction, while separators arranged in the same reservoir divide the space for the collected liquid and prevent the latter from shaking. A transparent window permits viewing of the liquid in the reservoir, while a float shuts off the suction of air when the level of the liquid reaches a predetermined value. In order to prevent any sprayed water from being drawn towards the vacuum cleaner and damaging its electric motor, baffle-plates and a filter are used. The reservoir is likewise provided with a plug for emptying.

BRIEF DESCRIPTION OF THE DRAWINGS

The appended drawings illustrate the embodiments of the present invention in which:

FIG. 1 is a front cross-sectional view taken through the center of the apparatus;

FIG. 2 is a side, cross-sectional view taken through the center of the apparatus; and FIG. 3 is a front perspective view of the apparatus.

DETAILED DESCRIPTION OF THE DRAWINGS

In the attached drawings the liquid aspirator includes an elongated body-reservoir 1, operatively connected at its lower portion to a nozzle 2, and closed off tightly at its upper portion by a lid 3, from which an end piece 4 protrudes. The end piece is fastened to an exterior hose (not shown) from a conventional vacuum cleaner. Lid 3 and end piece 4 are integrally molded into a combination lid-handle 5 which also serves as an extension of reservoir 1 and is provided with an opening 6, for the attachment of the vacuum cleaner hose.

Reservoir 1 continues at its lower portion into an end piece 7 which removably attaches to nozzle 2. The end piece 7 is partially positioned at the exterior of the elongated body reservoir, however a major portion extends to the interior of the reservoir in the form of a tube 8 which transfers the liquid which is collected by vacuum. Tube 8 leads into an inverted cup 9 without touching the cup. Cup 9 is secured laterally on an adjacent inner wall 10 of the elongated body-reservoir 1. The cup 9 provides for diversion of the air/liquid mixture as it is pulled into the device through tube 8.

Additional support members in the form of braces 11 are placed parallel to tube 8 and inside reservoir 1 preventing possible buckling during the suction by maintaining the opposing inner walls at a constant distance.

A convenient number of spacers 12 are arranged along the interior of the elongated body reservoir 1, the general area intended for the collected liquid. Spacers 12 act as baffle plates which prevent shaking of the liquid during the to-and-fro movement of the apparatus across the floor. A window 13, made of a transparent material, is placed along a longitudinal opening in reservoir 1 and permits the operator to observe the level of the liquid in the interior of the elongated body-reservoir.

A plug 14 closes outlet 15 which is provided in the base of the elongated body-reservoir 1. Liquid thus collected is emptied through outlet 15.

A retainer piece 16 is provided along the handle portion of the device, the contours of which follow the interior shape of the upper part of the elongated body-reservoir 1.

A pair of baffle plates 17, which are attached to retaining piece 16, are directed towards the center of the elongated body-reservoir 1. The baffle plates 17 are positioned to form a barrier against any sprayed water which may be drawn towards the attached vacuum cleaner to which the apparatus is attached.

During operation suction is provided by interaction between the interior of the elongated body-reservoir 1 and the attached vacuum cleaner, while at the same time a filter 18 retains any sprayed drops of water which might escape the barrier formed by baffle-plates 17. The filter 18 is positioned in a suitable opening cut in the retaining piece 16.

A moveable rod 19 passes through an opening in the retaining piece 16 and a float 20 is fastened to the lower portion of rod 19, while a valve 21 is attached to the upper portion. When the level of the liquid in the reservoir 1 rises and reaches the float, the float 20 rises with it until the valve 21 touches the opening of the end piece 4 and closes it. In this manner the vacuum cleaner, to which the apparatus is attached, is protected against the water which might enter and damage it when the level of the liquid in the elongated body-reservoir 1 goes beyond a predetermined amount.

The nozzle 2 may be any convenient shape and has a cylindrical upper part 22 which fits with pressure against the end piece 7. The cylindrical upper part has a cylindrical middle part 23 with the inner diameter the same as that of the inner diameter of the end piece 7. The cylindrical middle part 23 communicates with a conical part 24 having a base the same size as the base of the said part 23. A hollow and flattened body 25, having a triangular longitudinal section, which also forms a part of nozzle 2 intersects conical part 24.

The angle of the top is 60° which was established to assure only a minimal speed loss during suction.

The nozzle 2 terminates in an elongated absorption opening 26, the ratio between the length and width of this opening is about 19.

The conical part 24 has a convenient length such that coupling with the upper part of body 25 assures a passage speed of the liquid equal to that in the elongated absorption opening 26 or in the end piece 7.

What is claimed is:

1. A liquid aspirator for removing liquids from a flooring surface attachable to a vacuum cleaner comprising, in combination:

an elongated body-reservoir for retaining collected liquid therein including a liquid pick-up nozzle means at the lower end thereof and a unitary closure lid at the other, and a central tube positioned in the central axis of and extending substantially through said body-reservoir, the lower end of said tube communicating with said liquid pick-up nozzle means and the upper end thereof terminating adjacent said closure lid, the interior of said body-reservoir including a plurality of braces extending between the opposing inner walls of said body-reservoir to support the inner walls of said body-reservoir, preventing buckling of said supported inner walls due to suction present in said body-reservoir while said aspirator is in use, inverted cup means spaced radially about the upper end of said tube for directing the flow of liquid therethrough downward from said tube away from said unitary closure lid and into said reservoir, said closure lid including an integral handle means for holding and moving said liquid aspirator in use and attachment means defining a channel in flow communication with said body-reservoir for receiving the hose of a vacuum cleaner, liquid attenuating filter means positioned between said body-reservoir and said closure lid for retaining the sprayed water which may be discharged past said inverted cup, and valve means for occluding air communication between said body-reservoir and said vacuum cleaner attachment means when the liquid in said body-reservoir reaches a predetermined level, said valve means including a float slidably retained within said body-reservoir actuating a rod and, in turn, a valve positioned within the channel of said attachment means.

2. The liquid aspirator of claim 1 wherein said body-reservoir includes a viewing window positioned vertically along the upper portion thereof.

3. A liquid aspirator for removing liquids from a flooring surface attachable to a vacuum cleaner comprising, in combination:

an elongated body-reservoir for retaining collected liquid therein including a liquid pick-up nozzle means at the lower end thereof and a unitary closure lid at the other, and a central tube positioned in and extending substantially through said body-reservoir, the lower end of said tube communicating with said liquid pick-up nozzle means and the upper end thereof terminating adjacent said closure lid, the interior of said body-reservoir including a plurality of braces extending between opposing inner walls of said body-reservoir supporting the inner walls of said body-reservoir preventing buckling of said supported inner walls due to the suction present in said body-reservoir while said aspirator is in use, inverted cup means spaced radially about the upper end of said tube for directing the flow of liquid therethrough downward from said tube away from said unitary closure lid and into said reservoir, said closure lid including an integral handle means for holding and moving said liquid aspirator in use and attachment means defining a channel in flow communication with said body-reservoir for receiving the hose of a vacuum cleaner, and valve means for occluding air communication between said body-reservoir and said vacuum cleaner attachment means when the liquid in said body-reservoir reaches a predetermined level, said valve means including a float slidably retained within said body-reservoir actuating a rod and, in turn, a valve positioned within the channel of said integral handle and attachment means.

4. The liquid aspirator as defined in claim 3 wherein said reservoir is provided with removable plug means for discharging the collected liquid.

5. The liquid aspirator as defined in claim 3 wherein said reservoir terminates at the lower end at a tapered end piece.

6. The liquid aspirator as defined in claim 3 wherein said liquid pick-up nozzle means has a cylindrical upper portion manually engageable with a friction fit on one end of said elongated body-reservoir, said cylindrical upper portion including a cylindrical middle portion having an inner diameter about equal to the inner diameter of said cylindrical upper portion, said cylindrical middle portion, in turn, extending into a conical portion including an outwardly tapered liquid pick-up portion.

7. The liquid aspirator as defined in claim 6 further including a hollow, triangularly shaped body having an elongated liquid pick-up opening therein communicating with said liquid pick-up nozzle, said triangular body tapered from said liquid pick-up nozzle outwardly at an angle of about 60° thereby providing optimum liquid aspiration suction, said elongated opening having a ratio of length to width of about 19.

8. The liquid aspirator as defined in claim 3 wherein said actuating rod is vertically actuated and extends into said body-reservoir and is retained in a guide means.

9. The liquid aspirator as defined in claim 3 further including a transverse perforate baffle secured to and substantially similar in shape to the interior shape of the upper portion of said elongated body-reservoir and a liquid attenuating filter means attached to said baffle, positioned in flow communication with said body-reservoir and said attachment means for preventing entrained water droplets from being sprayed into said vacuum cleaner.

* * * * *